US007445450B2

(12) United States Patent
Dung

(10) Patent No.: US 7,445,450 B2
(45) Date of Patent: Nov. 4, 2008

(54) DETACHABLE ASSEMBLY OF A HIGH CURRENT CABLE AND A CURRENT-CARRYING BUS BAR THAT EXTENDS HORIZONTALLY

(76) Inventor: Arndt Dung, Heuland 54, D-58093 Hagen (DE)

( * ) Notice: Subject to any disclaimer, the term of this patent is extended or adjusted under 35 U.S.C. 154(b) by 78 days.

(21) Appl. No.: 11/587,398

(22) PCT Filed: Apr. 15, 2005

(86) PCT No.: PCT/EP2005/003993

§ 371 (c)(1),
(2), (4) Date: Oct. 18, 2006

(87) PCT Pub. No.: WO2005/101578

PCT Pub. Date: Oct. 27, 2005

(65) Prior Publication Data

US 2008/0020643 A1 Jan. 24, 2008

(30) Foreign Application Priority Data

Apr. 19, 2004 (DE) ..... 10 2004 019 414

(51) Int. Cl.
*H01R 39/00* (2006.01)

(52) U.S. Cl. ..... 439/14; 439/507; 439/797

(58) Field of Classification Search ..... 439/6, 439/13, 14, 115, 507, 723, 796, 797, 798
See application file for complete search history.

(56) References Cited

U.S. PATENT DOCUMENTS 2,551,636 A * 5/1951 Ratigan ..... 279/112
2,849,777 A * 9/1958 Ridgers et al. ..... 174/42
3,380,014 A * 4/1968 Schenker et al. ..... 439/412
6,071,154 A * 6/2000 Dung ..... 439/801
7,168,977 B2 * 1/2007 Reibke et al. ..... 439/507
2008/0020643 A1 * 1/2008 Dung ..... 439/610
2008/0026645 A1 * 1/2008 Naufel et al. ..... 439/798
2008/0146089 A1 * 6/2008 Bundren ..... 439/798

FOREIGN PATENT DOCUMENTS

CH 376 975 A 4/1964
DE 34 23 175 C2 5/1987
DE 197 43 867 C1 4/1999

* cited by examiner

*Primary Examiner*—James Harvey
(74) *Attorney, Agent, or Firm*—Fritz Henfling

(57) ABSTRACT

For the purpose of facilitating consolidation of a high-tension cable (HT cable) with a bus bar that conducts electricity and extends horizontally, on which the HT cable is suspended, a contact pocket (21) for the connector piece (32) is provided, which is divided in the vertical orientation, designed for the cross-section of the solid connector piece (32) of the HT cable (31), of which pocket one of the partial pieces (first partial piece 211) is fixed in place on the bus bar, 11 the second partial piece (212) being articulated 25 onto the first partial piece (211) so as to pivot relative to the first partial piece (211), whereby the [word/words missing], which is pivoted against the first partial piece (211), fixing in place the solid connector piece (32) of the UT cable (31) assigned to the first partial piece (211) of the contact pocket (21) by means of horizontal displacement, in the accommodation formed by the first partial piece (211) and the second partial piece (212) of the contact pocket (21), is consolidated with the first partial piece (211) by means of releasable screw connections 27.

3 Claims, 1 Drawing Sheet

Figure 2:
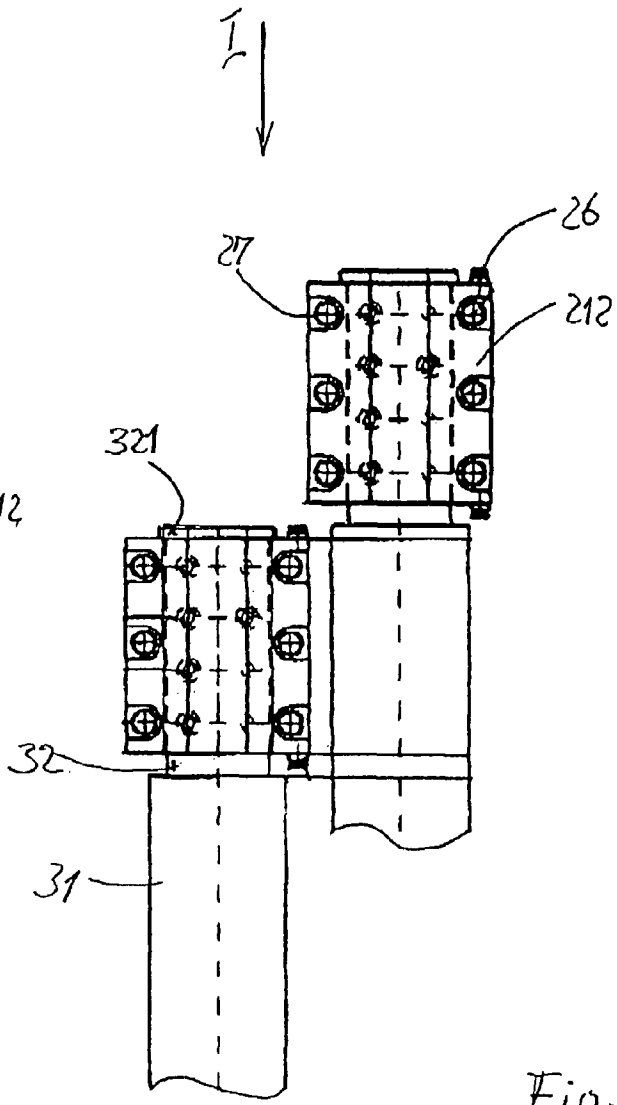

DETACHABLE ASSEMBLY OF A HIGH CURRENT CABLE AND A CURRENT-CARRYING BUS BAR THAT EXTENDS HORIZONTALLY

BACKGROUND OF THE INVENTION

The invention relates to the releasable consolidation of a high-tension cable (HT cable) with a bus bar that conducts electricity and extends horizontally (connector sword) on which the HT cable is suspended. Such connections or consolidations are described in DE 34 23 157 C1 and DE 197 43 687 C1, among others.

The connector piece of the HT cable and the corresponding cross-section of the accommodation for the connector piece configured in the contact pocket, as provided in the previously known solutions, the connector piece having the shape of a wedge, make it difficult to ensure that current transfer takes place without problems, as required, from the contact pocket set against the bus bar that conducts electricity to the solid connector piece of the HT cable. In terms of production technology, ensuring current transfer without problems is therefore relatively complicated. In the case of the solution according to DE 34 23 157 C1, it also proves to be problematic to set the solid connector piece of the HT cable on, because of the small amount of space between bus bar and access to the contact pocket. For continuously problem-fire fixation of the connector piece in the contact pocket, locking the connector piece in place in the contact pocket is also required (DE 197 43 867 C1). While a gripping jaw connection for a high current intensity conductor with a contact ring can be derived from CH 376975, whereby the current conductor can also be suspended in a vertical orientation, there is the problem of the risk of loosening of the grip, which is also the same in connection with the solutions according to DE-34 23 157 C1 and DE 197 42 867 C1, in the case of transfer of this manner of consolidation to the consolidation of the solid connector piece of a HT cable with a power cable having a bus bar that conducts electricity, with the result that the connector piece and therefore the HT cable come loose from the bus bar. Uncontrolled detachment of the HT cable from the bus bar in ongoing operation of the electric furnace provided with electrical energy by way of the HT cable would result in significant disruptions of operation. The furnace personnel must therefore constantly check that the connector piece of the HT cable is securely held in the contact pocket, and this also results in undesirable interruptions in operation.

BRIEF SUMMARY OF THE INVENTION

Proceeding from the known state of the art, the invention was based on the task of finding a solution for consolidating the solid end of a HT cable with the contact pocket set onto the bus bar that conducts electricity, which solution will not result in detachment of the connector piece from the contact pocket and therefore of the HT cable from the bus bar, even if the grip on the connector piece in the contact pocket becomes loose.

This task is accomplished with a releasable consolidation of an HT cable with a bus bar that conducts electricity and extends horizontally, on which the HT cable is suspended, of the type stated, in such a manner that the solid connector piece that can be releasably suspended into the contact pocket that forms an integral part of the connector piece is provided with a shoulder that rests on the contact pocket, on the face side.

The solution according to the invention avoids uncontrolled detachment of the solid connector piece of the HT cable from the contact pocket set onto the bus bar, and therefore avoids disruptions of ongoing operation, particularly of electric furnaces, which result from the detachment. This solution furthermore proves to be advantageous also in connection with replacement of the HT cable, which can weigh up to 800 kg, since the replacement of the HT cable, which must be performed at a greater height above the production facility floor, at intervals, is facilitated thereby.

The solution according to the invention facilitates assignment and then also detachment of the HT cable from the bus bar that conducts electricity, particularly the cylindrical design of the solid connector piece of the HT cable, in other words its round cross-section and, in connection with this, the corresponding configuration of the accommodation in the contact pocket facilitate the production of dimensionally stable contact surfaces of the connector piece, on the one hand, and the contact pocket, on the other hand, which assure problem-free current transfer from the contact pocket to the connector piece. If longitudinal grooves configured in the vertical orientation are provided in the contact surfaces of the connector piece of the HT cable and/or the contact surfaces of the contact pocket, this contributes to continued good current transfer from the contact pocket set onto the bus bar to the connector piece of the HT cable.

BRIEF DDESCPITION OF THE DRAWING

Figure 1:
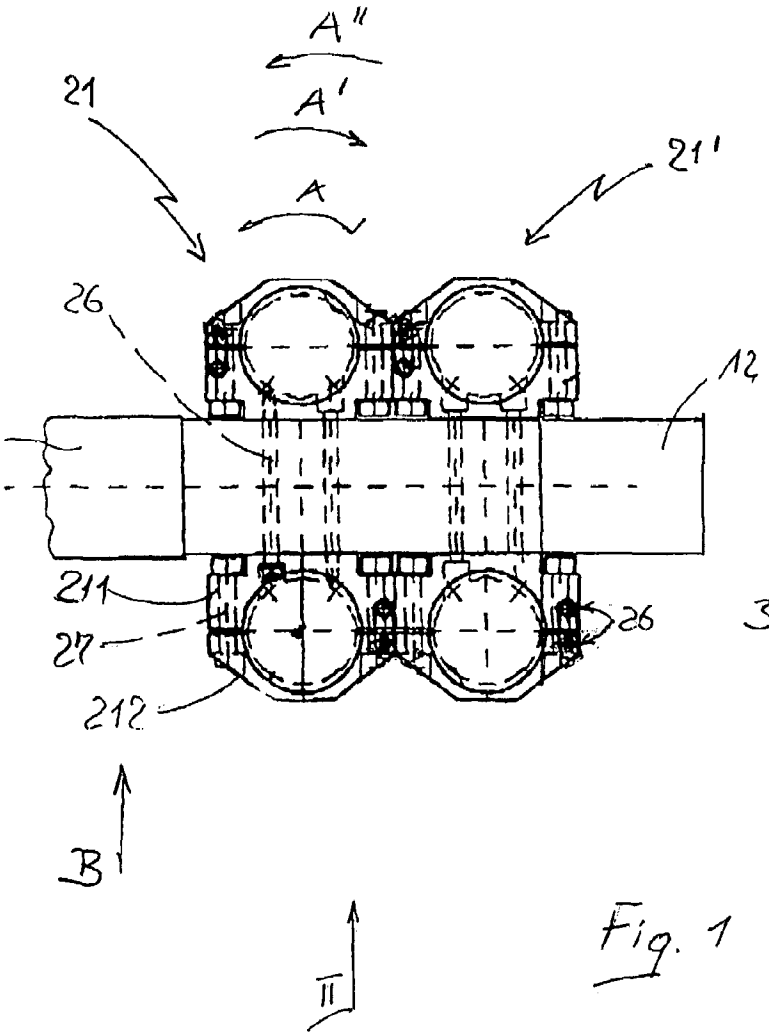

In the drawing, the invention is explained in further detail using an exemplary embodiment. The drawing shows:

FIG. 1 the connection between a plurality of high-tension cables with a connector sword in a top view (view in the direction of the arrow I in FIG. 2), FIG. 2 the ensemble shown in FIG. 1 in a front view (arrow II in FIG. 1).

DESCRIPTION OF THE INVENTION

The connector sword that proceeds from the bus bar 11 in the drawing is designated as 12. Four contact pockets 21, 21', 21", 21'" are set onto the connector sword 12, specifically lying in pairs opposite one another.

In the solution shown, the solid ends 32 of the high-tension cables 31 have a round cross-section. Accordingly, the accommodations 22 of the contact pockets 21, 21', etc., then also have a corresponding round cross-section In order to make insertion of the solid connector piece into the contact pocket, in each instance, possible, it is necessary, in the case of this solution, to divide the contact pockets longitudinally, in the alignment of their bisecting line(s), in the vertical orientation.

The base partial piece 211 of the divided (211, 212) contact pockets 21, 21', etc., is screwed together (26) with the connector sword 12. The second partial piece 212 that can be set onto the base partial piece 211 is consolidated with the base partial piece 211 by way of a joint 26 that allows pivoting of the second partial piece 212 relative to the base partial piece 211, in the direction of the double arrow A. Once the second partial piece 212 of the contact pocket 21 has been pivoted in the direction of the arrow A', the possibility is opened up of inserting the solid end 32 of the high-tension cable 21, which rests against the base partial piece 211 of the contact pocket 21 after it has been inserted into the base partial piece 211, with its shoulder 321 formed on its face side, upside down (arrow B in FIG. 1). After insertion of the solid end 32 of the high-tension cable 31, the second partial piece 212 of the contact pocket 21 is pivoted in the direction of the arrow A", against the base partial piece 211 of the contact pocket, and fixed in place, wedged in the contact pocket 21, with the base partial piece 211, by means of screwing together (27) the solid end 211 of the high-tension cable 21 Multiple screw connections are provided with regard to both the base partial piece 211 of the contact pocket 21 and the second partial piece 212 that forms an integral part of the contact pocket 21.

The invention claimed is:

1. A releasable consolidation of a vertically suspended high-tension cable having a horizontally extending bus bar conducting electricity comprising:

a contact pocket divided vertically into partial pieces for electrically connecting with a solid connector piece, a first one of said partial pieces being fixed in place on said bus bar, a second one of said partial pieces being articulated onto said first partial piece for pivoting relative to said first partial piece;

said solid connector piece being fixed in to said first partial piece and said second partial piece when said second partial piece is pivoted against said first partial piece;

a shoulder on said solid connector piece resting on a face side of said contact pocket;

longitudinal grooves on at least said solid connector piece; and a releasable screw connector for consolidating said first partial piece and said second partial piece.

2. A releasable consolidation as defined in claim 1, wherein said contact pocket has means for accommodating a round cross-section of said solid connector piece.

3. A releasable consolidation as defined in claim 1, including a screw connection for consolidating said first partial piece with said bus bar.

* * * * *